US008502059B2

(12) United States Patent
Sasaki et al.

(10) Patent No.: US 8,502,059 B2
(45) Date of Patent: Aug. 6, 2013

(54) MUSICAL INSTRUMENT HAVING CONTROLLER EXACTLY DISCRIMINATING HALF-PEDAL AND CONTROLLING SYSTEM USED THEREIN

(75) Inventors: Tsutomu Sasaki, Shizuoka-Ken (JP); Shigeki Iida, Shizuoka-Ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 232 days.

(21) Appl. No.: 11/623,128

(22) Filed: Jan. 15, 2007

(65) Prior Publication Data

US 2007/0214944 A1 Sep. 20, 2007

(30) Foreign Application Priority Data

Mar. 20, 2006 (JP) ..... 2006-077381

(51) Int. Cl.
*G10H 1/00* (2006.01)

(52) U.S. Cl.
USPC ..... 84/615

(58) Field of Classification Search
USPC ..... 84/622, 626, 627, 633, 645, 659, 84/662, 663, 665, 692, 701, 702, 711, 721, 84/735, 746, 615
See application file for complete search history.

(56) References Cited

U.S. PATENT DOCUMENTS

| | | | | |
|---|---|---|---|---|
| 4,909,121 | A | 3/1990 | Usa et al. | |
| 5,131,306 | A | 7/1992 | Yamamoto | |
| 5,523,522 | A | 6/1996 | Koseki et al. | |
| 5,569,870 | A | 10/1996 | Hirano | |
| 5,663,513 | A | 9/1997 | Sugiyama et al. | |
| 6,362,405 | B2 * | 3/2002 | Koseki et al. | 84/2 |
| 2006/0021488 | A1 | 2/2006 | Fujiwara et al. | |
| 2006/0112809 | A1 * | 6/2006 | Muramatsu et al. | 84/484 |

FOREIGN PATENT DOCUMENTS

| | | | |
|---|---|---|---|
| JP | HEI 8-7575 | | 10/1991 |
| JP | 2002-091447 | | 3/2002 |
| JP | 2002091447 | A * | 3/2002 |

* cited by examiner

*Primary Examiner* — Jianchun Qin
(74) *Attorney, Agent, or Firm* — Harness, Dickey & Pierce, PLC

(57) ABSTRACT

A mute piano is responsive to key movements and pedal movements so as to produce music data codes expressing the pitch of tones and pedal effect to be given to the tones in accordance with the MIDI protocols, and the damper pedal stroke is divided into a rest region, a half-pedal region and a damper-free region which are expressed by difference numerical ranges of data bytes of the musical data code: since the piano has its own individuality, the relation between the pedal position and the value of data bytes is to be calibrated; the controller of the mute piano enters a calibration mode, and optimizes the relation to the actual damper actions, thereby causing the music data code exactly to express the effect of the damper pedal to be given to the tones.

21 Claims, 6 Drawing Sheets

Figure 1:
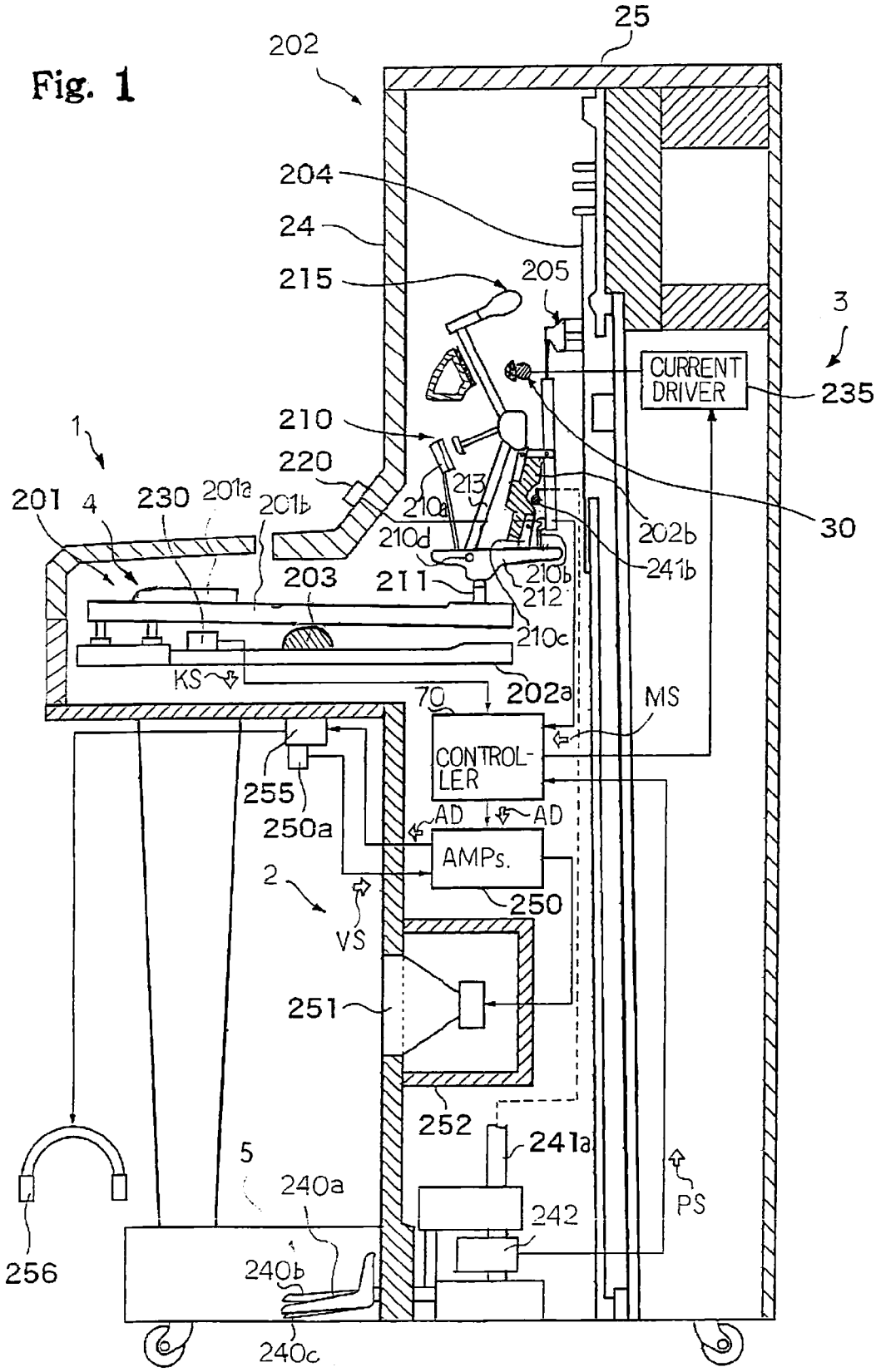

MUSICAL INSTRUMENT HAVING CONTROLLER EXACTLY DISCRIMINATING HALF-PEDAL AND CONTROLLING SYSTEM USED THEREIN

FIELD OF THE INVENTION

This invention relates to a musical instrument and, more particularly, to a keyboard musical instrument having a pedal system monitored with a pedal sensor or sensors for converting the movement of the pedal or pedals to an electric signal and a controlling system incorporated in the keyboard musical instrument.

DESCRIPTION OF THE RELATED ART

A mute piano is an example of the keyboard musical instrument of the type having a pedal system monitored with a pedal sensor or sensors. The mute piano is a combination of an acoustic piano and an electronic system. It is possible for a user sequentially to produce acoustic piano tones along a music passage. In other words, the user has the use of mute piano as an ordinary piano, and this usage is hereinafter referred to as "acoustic playing mode". The mute piano is changeable from the acoustic playing mode to a mute mode. When the user changes the mute piano to the mute mode, the acoustic piano is prohibited from the production of acoustic piano tones. Instead, electronic tones are produced through the electronic system.

While the user is performing a music passage in the mute mode, the movements of the black and white keys and pedal are analyzed by the electronic system for producing the electronic tones. When the electronic system notices the user depress a black key and release a white key, the electronic system starts to produce the tone at the pitch assigned to the black key, and starts to decay the tone at the pitch assigned to the white key. When the electronic system notices the user step on a pedal, the electronic system gives the effect expressed by the pedal to the tone or tones.

One of the pedals is called as a "damper pedal", and players frequently step on during their performances. The damper pedal is linked with a damper mechanism, and the damper mechanism makes the dampers spaced from the strings and brought into contact with the strings, again. The trajectory of dampers is broken down into three regions, which are hereinafter referred to as a "rest region", a "half-pedal region" and a "damper-free region", respectively. While a player is pressing down the damper pedal, the damper pedal is firstly moved in the rest region, passes through the half-pedal region, and finally enters the damper-free region.

While the damper pedal is moving in the rest region the damper mechanism takes up the movement of the damper pedal, and the damper still exerts the force on the string as large as the force at the rest position. When the damper pedal enters the half-pedal region, the damper starts to reduce the force exerted on the string. However, the damper is still in contact with the string. The damper pedal is lightly in contact with the string in the half pedal region, and makes the loudness of tones reduced through the decay of the vibrations of string. When the damper pedal enters the damper-free region, the damper is spaced from the string and any permits the string freely to vibrate. As a result, the tones are prolonged. The players sometimes keep the damper pedal in the half-pedal region and in the damper-free region so as to give delicate artificial expressions to the acoustic piano tone or tones.

While a user is performing a music passage in the mute mode, the electronic system is expected correctly to discriminate the half-pedal region from the rest region and damper-free region so as to give the appropriate effect to the electronic tone or tones. In order to monitor the damper pedal, a pedal sensor is provided in association with the damper pedal, and reports the pedal stroke to the controller. The controller determines the pedal region on the basis of the pedal stroke. However, the player feels the effect of damper pedal different between the acoustic piano tones and the electronic tones. The difference in pedal effect also takes place in the recording.

The reason why the damper pedal gives the effect to the electronic tones differently from the acoustic piano tones is the relative sensor position to the damper pedal. Although workers of the manufacturer try to locate the pedal sensors at a target position with respect to the damper pedals in the factory, a small amount of deviation is unavoidable. Moreover, the pedal sensors may be slightly moved from the target position after the delivery to users. Thus, the unstable sensor position is a problem of the prior art mute piano. The unstable sensor position is also the trouble in other sorts of keyboard musical instruments such as, for example, an automatic player piano and electronic keyboards.

A counter measure is proposed in Japanese Patent Publication No. Hei 8-7575. In the Japanese Patent Publication, the damper pedal stroke is correlated with the amount of mean current of the driving signal. It is important exactly to discriminate the half-pedal region from the other two regions. In order precisely to determine the damper pedal stroke around the boundary between the half pedal region and the other two regions, the prior art inventor proposes in the Japanese Patent Publication that damper pedal stroke is determined at high resolution in the half pedal region and at low resolution in the other regions. The relation between the actual pedal stroke and the modified pedal stroke at different resolution is defined in the normalization table and inverted normalization table.

The prior art inventor further proposes to calibrate the relation in the half pedal region. Although the relation between the pedal stroke and the amount of mean current of driving signal is corrected through the modified pedal stroke, the individualities of automatic player piano are not taken into account for the relation between the actual pedal stroke and the amount of means current of driving signal. As a result, the half pedal effect and damper effect are not exactly given to the piano tones in the playback. This is the problem inherent in the prior art controller disclosed in the Japanese Patent Publication.

SUMMARY OF THE INVENTION

It is therefore an important object of the present invention to provide a keyboard musical instrument, through which different pedal effects are given to tones exactly same as an original performance.

It is also an important object of the present invention to provide a controlling system, which is incorporated in the keyboard musical instrument.

To accomplish the object, the present invention proposes to optimize relation between an input value and the value of a music data code expressing a pedal effect to be given to the tones.

In accordance with one aspect of the present invention, there is provided a musical instrument for producing pieces of music data expressing tones, and the musical instrument comprises a keyboard having plural keys selectively depressed so as to specify pitch of the tones, at least one pedal pressed down so as to specify to a pedal effect to be given to at least one of the tones and moved along a pedal trajectory divided into more than two regions assigned to the tones without any pedal effect and plural pedal effects different from one another, a tone generator connected to the plural keys and the aforesaid at least one pedal, producing the tones at the specified pitch and giving the pedal effect to the aforesaid at least one of the tones, plural key sensors monitoring the plural keys and producing key signals representative of key movements, at least one pedal sensor monitoring the aforesaid at least one pedal and producing a pedal signal representative of a pedal movement on the pedal trajectory and a controller connected to the plural key sensors and the aforesaid at least one pedal sensor, producing music data codes defined in music protocols and expressing at least the specified pitch of the tones and the pedal effect to be given to the aforesaid at least one of the tones on the basis of the key signals, the pedal signal and relation between an input value expressing a current physical quantity of the aforesaid at least one pedal and a value of the music data code expressing the pedal effect and having a memory storing the relation in a rewritable manner so as to make it possible to optimize the relation with respect to actual movements of component parts of the tone generator related to the pedal effects.

In accordance with another aspect of the present invention, there is provided a controlling system for a musical instrument having plural keys respectively assigned pitch names of tones to be produced and at least one pedal moved along a pedal trajectory divided into more than two regions assigned to the tones without any pedal effect and plural pedal effects different from one another, and the controlling system comprises plural key sensors monitoring the plural keys and producing key signals representative of key movements, at least one pedal sensor monitoring the aforesaid at least one pedal and producing a pedal signal representative of a pedal movement on the pedal trajectory and a controller connected to the plural key sensors and the aforesaid at least one pedal sensor, producing music data codes defined in music protocols and expressing at least the specified pitch of the tones and the pedal effect to be given to the aforesaid at least one of the tones on the basis of the key signals, the pedal signal and relation between an input value expressing a current physical quantity of the aforesaid at least one pedal and a value of the music data code expressing the pedal effect and having a memory storing the relation in a rewritable manner so as to make it possible to optimize the relation with respect to actual movements of component parts of the tone generator related to the pedal effects.

BRIEF DESCRIPTION OF TI-IE DRAWINGS

Figure 2:
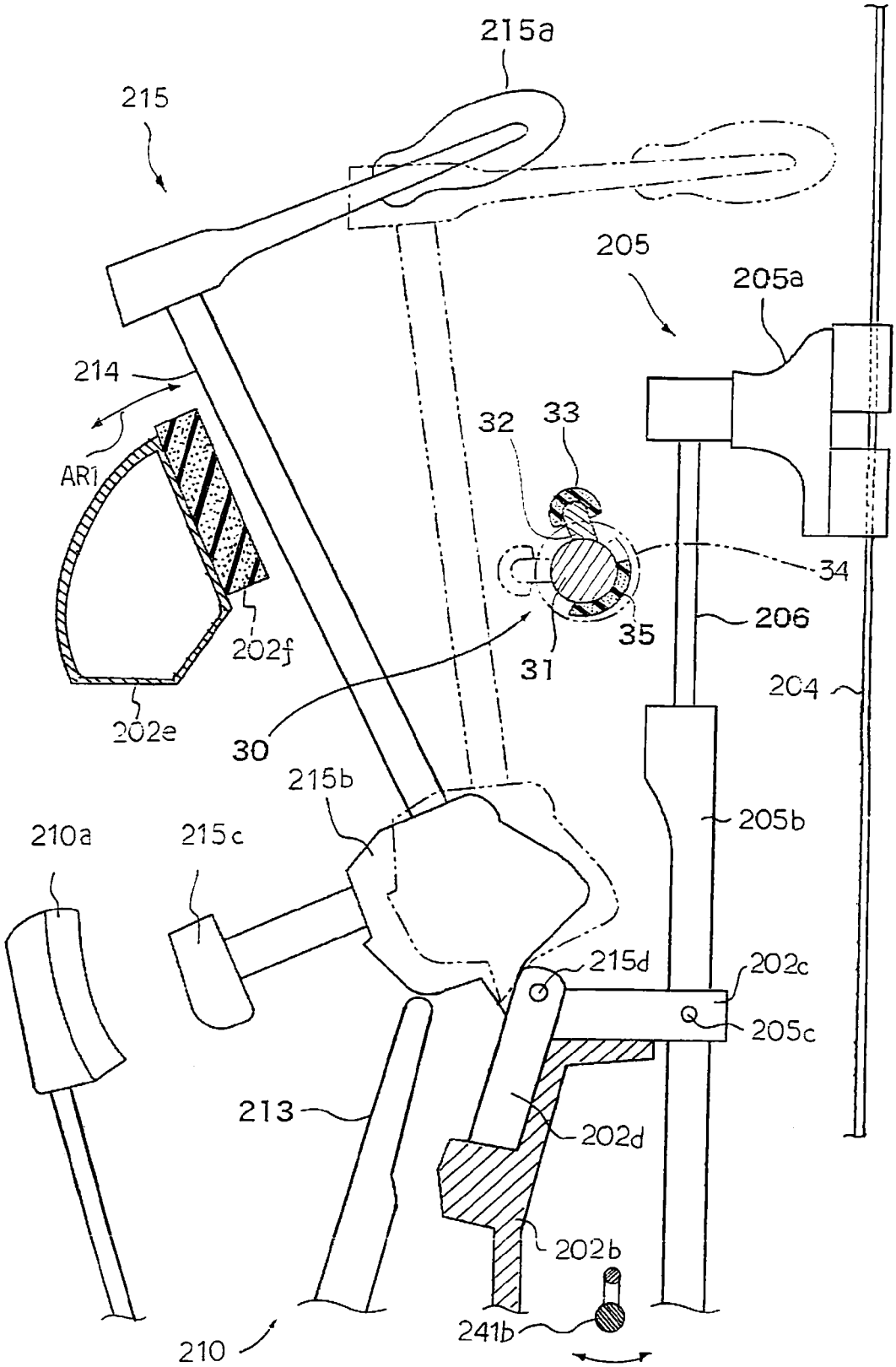
Figure 3:
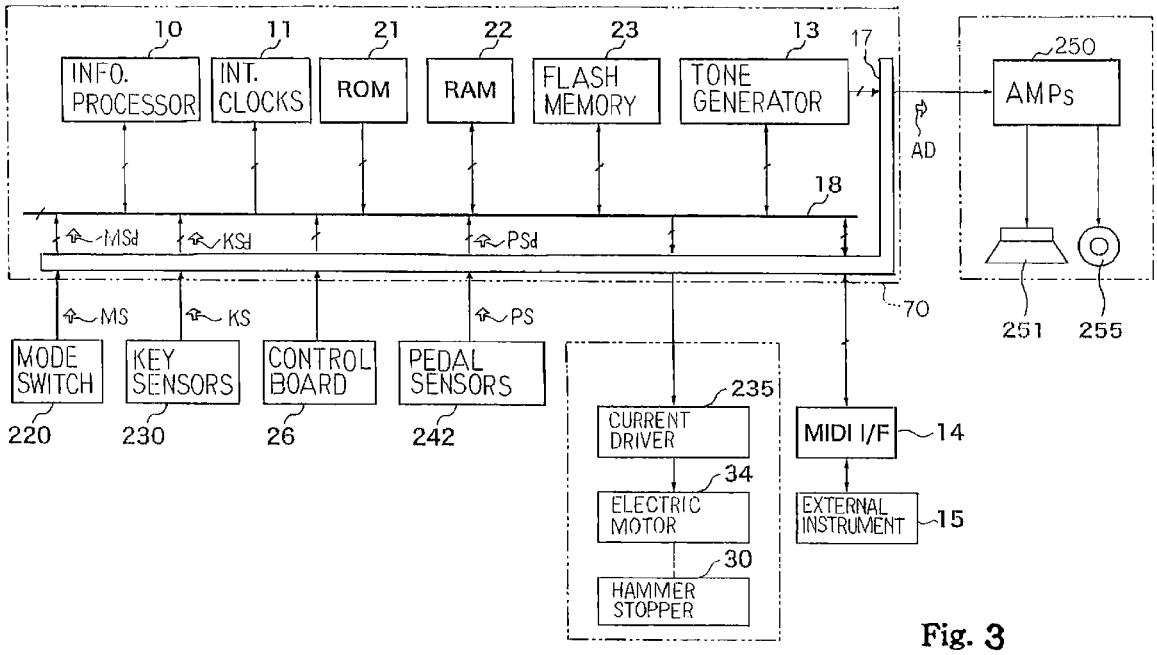
Figure 4:
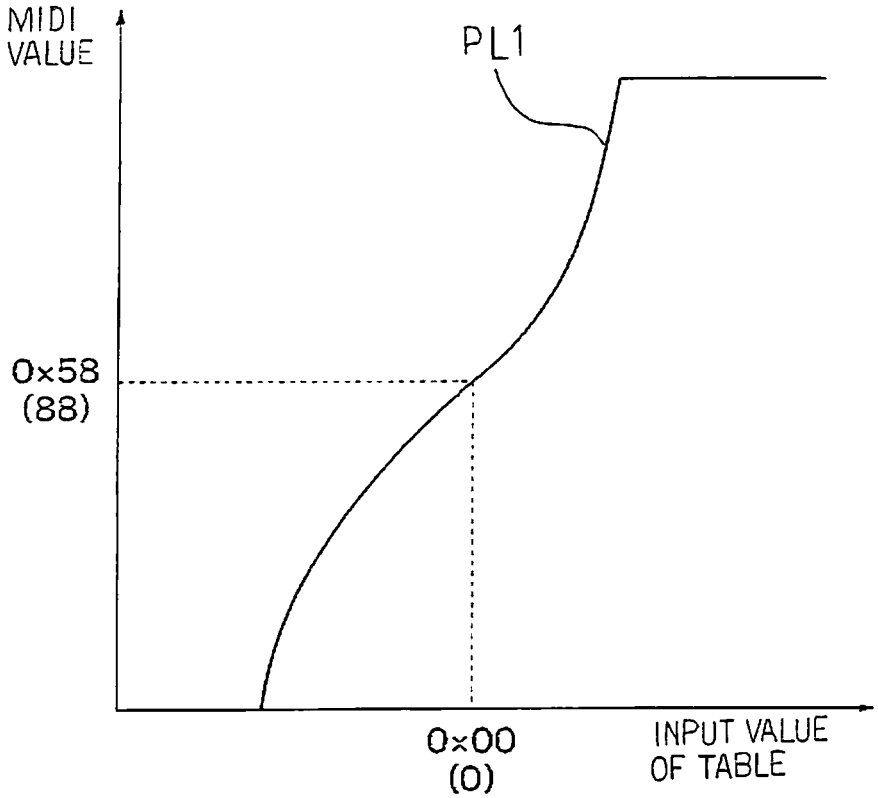
Figure 5:
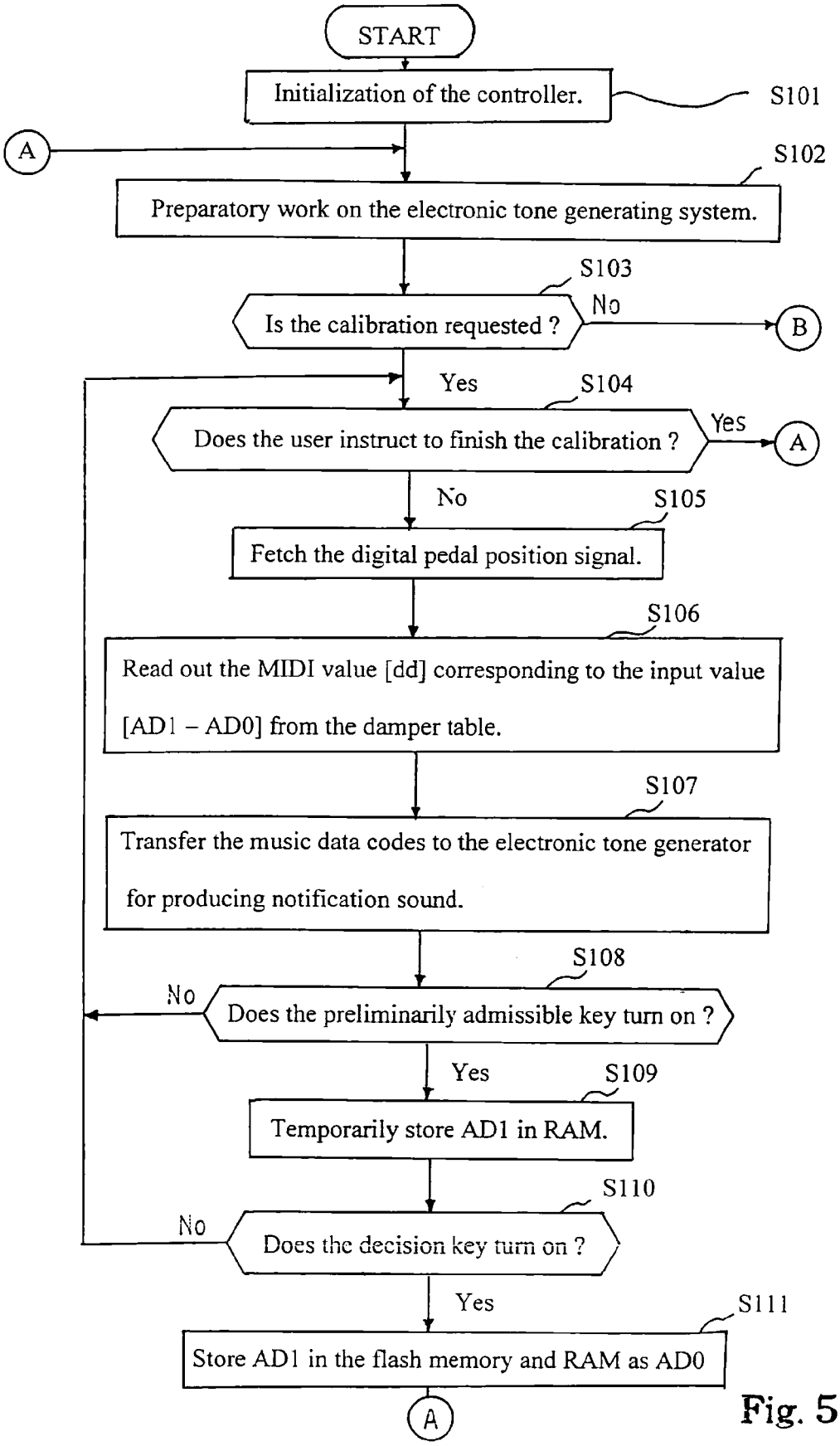
Figure 6:
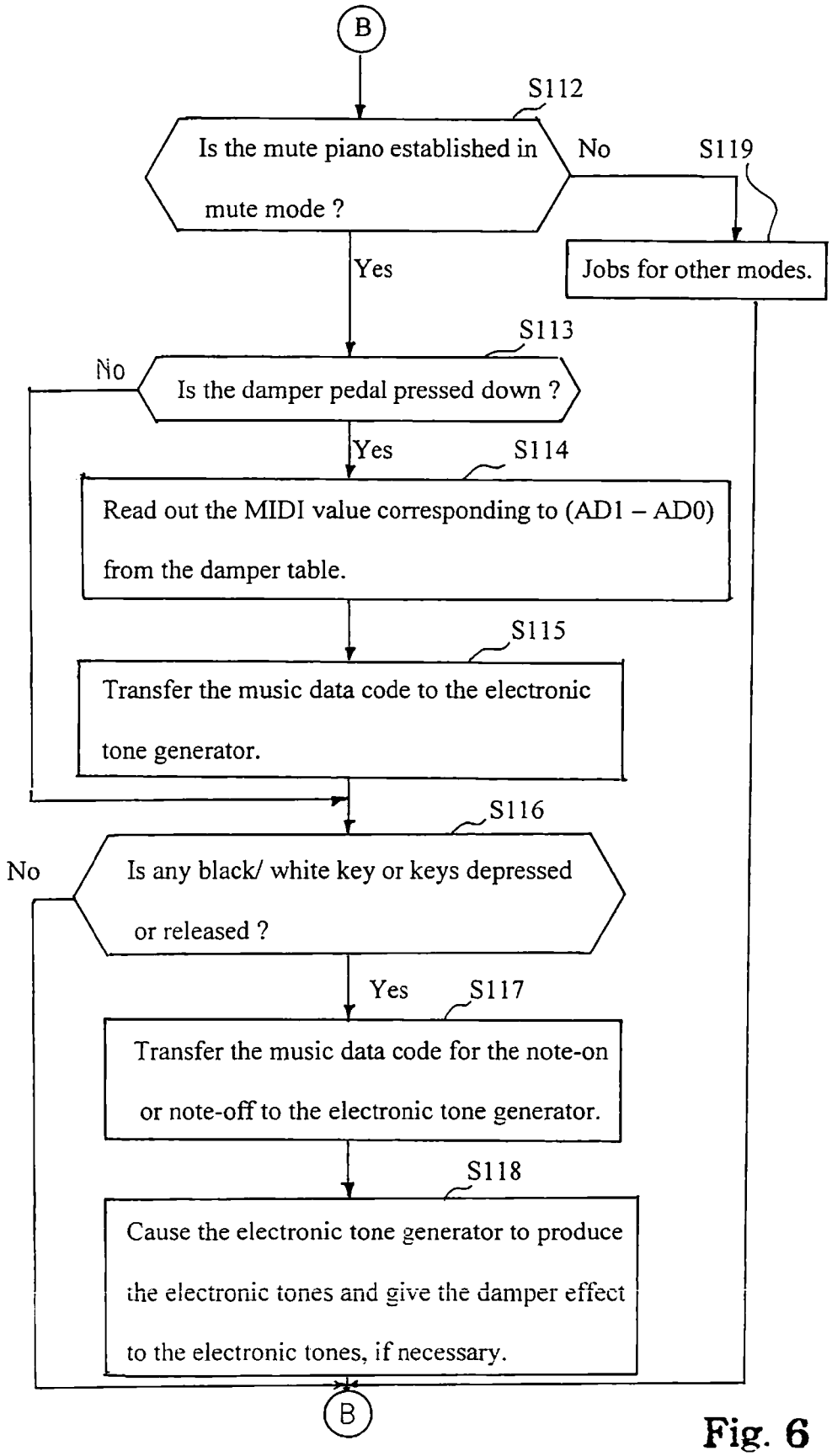

The features and advantages of the keyboard musical instrument and controlling system will be more clearly understood from the following description taken in conjunction with the accompanying drawings, in which FIG. 1 is a cross sectional side view showing the structure of a mute piano according to the present invention, FIG. 2 is a cross sectional side view showing a hammer, a hammer stopper and a damper incorporated in the mute piano, FIG. 3 is a block diagram showing the system configuration of a controller incorporated in the mute piano, FIG. 4 is a graph showing contents of a damper pedal table, and FIGS. 5 and 6 are flowchart showing an essential part of a computer program installed in the mute piano.

DESCRIPTION OF THE PREFERRED EMBODIMENTS

In the following description, term "front" is indicative of a relative position closer to a player, who gets ready to play a tune, than a relative position modified with term "rear". A line drawn between a front position and a corresponding rear position extends in a "fore-and-aft direction", and a lateral direction crosses the fore-and-aft direction at right angle. An "up-and-down direction" is normal to a plane defined by the fore-and-aft direction and lateral direction. "Clockwise direction" and "counter clockwise direction" are determined on the sheet of paper where a figure, which is just referred to, is drawn.

A musical instrument embodying the present invention is used for producing tones expressed by pieces of music data, and comprises a keyboard provided with plural keys, at least one pedal, a tone generator, plural key sensors, at least one pedal sensor and a controller. The keys and pedal are connected to the tone generator and the key sensors and pedal sensor are connected to the controller.

The keys are selectively depressed in a performance on a music passage so as to specify pitch of the tones, and the pedal pressed down in the performance so as to specify to a pedal effect to be given to at least one of the tones. The pedal is moved along a pedal trajectory, which is divided into more than two regions, and the more than two regions are assigned to the tones without any pedal effect and plural pedal effects different from one another. Thus, the pedal effect to be given to the tones is depending upon the region where the pedal is found. The tone generator produces the tones at the specified pitch. Certain component parts of tone generator relate to the pedal effects so that the pedal effect is given to at least one of the tones through the behavior of the component parts.

The plural key sensors monitor the plural keys, respectively, and the pedal sensor monitors the pedal. The plural key sensors produce key signals representative of key movements, and the key signals are supplied to the controller. Similarly, the pedal sensor produces a pedal signal representative of a pedal movement on the pedal trajectory, and the pedal signal is supplied to the controller.

While the plural keys and pedal are being selectively depressed in the performance, the controller produces music data codes defined in music protocols. When the keys are depressed, the controller produces the music data codes expressing at least the specified pitch of the tones on the basis of the key signals. On the other hand, when the pedal is pressed down, the controller produces the music data codes expressing the pedal effect to be given to at least one of the tones on the basis of the pedal signal and relation between an input value expressing a current physical quantity of the pedal and a value of the music data code expressing the pedal effect.

In order to store the relation, the controller has a memory, and the memory permits a worker or user to rewrite the relation. In case where the user finds the controller to give a pedal effect different from the effect to be given to the tones, the relation is optimized. In the optimizing work, a worker draws his or her attention to the actual movement of the component parts of the tone generator, and inspects the relation for the mismatch between the more than two regions and the pedal effects. If the mismatch is found, the relation is corrected, and is stored in the memory, again. Thus, the worker makes it possible exactly to give the pedal effects to the tones through the correction of the relation.

Referring to FIG. 1 of the drawings, a mute piano embodying the present invention largely comprises an upright piano 1, an electronic tone generating system 2 and a mute system 3 and, and the mute system 3 and electronic tone generating system 2 are installed in the upright piano 1.

The upright piano is equipped with a mechanical tone generating system 4 and a pedal system 5. A player produces acoustic piano tones along music passages through the mechanical tone generating system 4, and gives effects to the acoustic piano tones through the pedal system 5. The electronic system 2 monitors the mechanical tone generating system 4 and pedal system 5. The player produces electronic tones through the electronic tone generating system 2 at the pitch of corresponding acoustic piano tones to be produced, and gives the effects to the electronic tones as similar to those given to the acoustic piano tones.

The mute system 3 is provided in association with the mechanical tone generating system 4, and makes the mechanical tone generating system 4 active and inactive. While the mute system 3 is making the mechanical tone generating system 4 active, the mute piano is in the acoustic playing mode, and a player plays pieces of music on the upright piano 1 through the acoustic piano tones. On the other hand, when mute system 3 makes the mechanical tone generating system 4 inactive, the mute piano is changed to the mute mode so that the acoustic piano tones are not produced. Instead, the player hears the electronic tones produced through the electronic tone generating system 2. In this instance, the electronic tones are produced on the basis of a set of music data codes supplied from the outside of the mute piano through the electronic tone generating system 2 so that the mute piano has not only the mute mode but also an electronic tone playing mode.

The upright piano 2 further includes a keyboard 201, strings 4, dampers 205, action units 210, a piano cabinet 202, hammers 215. The keyboard 201 is placed on a keyboard 202 of the piano cabinet 202, and the strings 4, dampers 205, action units 210 and hammers 215, which form in combination the mechanical tone generating system 4, is housed in the piano cabinet 202. An upper front board 24 of the piano cabinet 202 laterally extends over the keyboard 201, and a top board 25 defines the uppermost extent of the piano cabinet 202.

The keyboard 201 has black keys 201*a* and white keys 201*b*, and pitch names are respectively assigned to the black and white keys 201*a* and 201*b*. In this instance, eighty-eight keys 201*a* and 201*b* are incorporated in the keyboard 201, and are laid on the well-known pattern. A balance rail 203 laterally extends on the key bed 202*a*, and offers fulcrums to the black keys 201*a* and white keys 201*b*. The black keys 201*a* and white keys 201*b* independently pitch up and down.

Capstan screws 211 are upright from the rear portions of the black keys 201*a* and white keys 201*b*, and are respectively connected to the action units 210. For this reason, the movements of the black and white keys 201*a* and 201*b* make the associated action units 210 actuate. The hammers 215 are associated with the action units 210, respectively, and are driven for rotation toward the strings 204 through escape.

The action unit 210 includes a back check 210*a*, a damper spoon 210*b*, a whippen assembly 212 and a jack 213. A center rail 202*b* extends in the lateral direction over the rear portions of the black and white keys 201*a* and 201*b*, and is supported by action brackets (not shown) on the key bed 202*a*. Whippen flanges 210*c* are secured to the center rail 202*b* at intervals, and one of the whippen flanges 210*c* is assigned to the action unit 210. The whippen assembly 212 is connected to the whippen flange 210*c*, and is rotatable about the whippen flange 210*c*. The back check 210*a* projects from the front portion of the whippen assembly 212 in the upward direction, and a damper spoon 210*b* projects at the back of the whippen flange 210*c* in the upward direction. The jack 213 is connected to the intermediate portion of the whippen assembly 212 by means of a pin 210*d* so that the jack 213 and whippen assembly 212 are rotatable with one another. The jack 213 and back check 210*a* are provided in association with the hammer 215, and the damper spoon 210*b* is connected to the damper 205. The jack 213 and back check 210*a* and the damper spoon 210*b* are hereinlater described in conjunction with the hammer 215 and damper 205.

The strings 204 are designed to produce the acoustic piano tones at the pitch names assigned to the associated black and white keys 201*a* and 201*b*, and are provided on trajectories of the associated hammers 215. The hammers 215 are brought into collision with the strings 204 at the end of rotation, and give rise to vibrations of the associated strings 204. The acoustic piano tones are produced through the vibrations of the strings 204.

FIG. 2 shows the damper 205, action unit 210, hammer 215 and a hammer stopper 30, which forms a part of the mute system 3. Damper lever flanges 202*c* and hammer butt flanges 202*d* are secured to the center rail 202*b*. The damper lever flanges 202*c* are assigned to the dampers 205, respectively, and hammer butt flanges 202*d* are respectively assigned to the hammers 215. One of the damper lever flanges 202*c* and one of the hammer butt flanges 202*d* are respectively provided for the damper 205 and hammer 215.

The damper 205 has a damper head 205*a*, a damper lever 205*b* and a damper wire 206. The damper lever 205*b* is connected to one of the damper lever flanges 202*c* by means of a pin 205*c*, and is rotational about the damper lever flange 202*c*. The damper wire 206 projects from the upper end surface of the damper lever 205*b* in the upward direction, and the damper head 205*a* is connected to the leading end of the damper wire 206. The lower end portion of the damper lever 205*b* is held in contact with the damper spoon 210*b* (see FIG. 1).

While the associated action unit 210 is being actuated by the depressed key 201*a*/201*b*, the action unit 210 causes the damper lever 205*b* to rotate in the counter clockwise direction. The damper spoon 210*b* exerts force on the lower end portion of the damper lever 205*b*, and gives rise to rotation of the damper lever 205*b* in the counter clockwise direction. The damper head 205*a* is gradually spaced from the string 204 so as to permit the string 204 to vibrate.

The hammer 215 includes a hammer shank 214, a hammer head 215*a*, a hammer butt 215*b* and a catcher 215*c*. The hammer butt 215*b* is connected to the hammer but flange 202*d* by means of a pin 215*d* so that the hammer butt 215*b* is rotatable about the pin 215*d*. The hammer shank 214 projects from the hammer butt 215*b* in the upward direction, and the catcher 215*c* projects from the hammer butt 215*b* in the frontward direction. The hammer head 215*a* is connected to the leading end of the hammer shank 214, and is moved on the hammer trajectory which the associated string 204 crosses.

While the action unit 210 is staying at the rest position, the jack 213 is held in contact with the lower surface of the hammer butt 215*b*, and the back check 210*a* is spaced from the catcher 215*c*. The associated black/white key 201*a*/201*b* is assumed to be depressed. The capstan screw 211 (see FIG. 1) pushes the whippen assembly 212 upwardly so that the whippen assembly 212 is rotated in the clockwise direction. The jack 213 pushes the hammer butt 215*b*, and gets closer toward an associated regulating button (not shown). When the jack 213 is brought into contact with the regulating button, the jack 213 rotates about the whippen assembly 212 in the counter clockwise direction, and is escaped from the hammer butt 215*b*. The jack 213 exerts force on the hammer butt 215*b* during the escape due to the friction, and gives rise to rotation of the hammer 215 in the clockwise direction. Thus, the hammer 215 is driven for rotation by the associated action unit 210.

The hammer head 215*a* is brought into collision with the string 204 at the end of rotation. The hammer 215 rebounds on the string 204, and starts the rotation in the counter clockwise direction. The catcher 215*c* is bought into contact with the back check 210*a*, and stays thereon.

When the player releases the depressed key 201*a*/201*b*, the rear portion of the black/white key 201*a*/201*b* is sunk due to the weight of the action unit 210. The whippen assembly 212 is rotated in the clockwise direction together with the jack 213 and back check 210*a*. The jack 213 slides into the space below the hammer butt 215*b*, and is brought into contact with the lower surface of the hammer butt 215*b*, again. The back check 210*a* is left from the catcher 215*c*, and, finally, the action unit 210 and hammer 215 return to the rest positions, respectively.

A hammer rail 202*e* extends in the lateral direction in front of the hammer shanks 214, and a hammer rail cloth 202*f* is adhered to the rear surface of the hammer rail 202*e*. The hammer shanks 214 rest on the hammer rail 214 at the rest positions. The hammer rail 202*e* is movable in the direction indicated by arrow AR1, and pushes the hammer shanks 214 toward the strings 204. The behavior of hammer rail 202*e* will be described in conjunction with the pedal system 5.

The hammer stopper 30 includes a shaft 31, brackets 32 cushions 33 and 34 and an electric motor 34 such as a stepping motor. The shaft 31 extends in the space between the hammer shanks 214 and damper wires 206 in the lateral direction, and is rotatably supported by suitable bearings attached to the piano cabinet 202. The brackets 32 are secured to the shaft 31 at intervals, and are wrapped with the cushions 33. In this instance, the keyboard 201 is dividable into three registers, and the three brackets 32 are prepared for these three registers. The other cushion 34 is directly adhered to the shaft 31. The cushions 33 and 34 are made of felt or urethane The electric motor 34 is connected to one end portion of the shaft 31, and a controller 70 (see FIG. 1) drives the electric motor 34 so as to give rise to the rotation of the shaft 31. The controller 70 is a system component of the mute system 3. While the hammer stopper 30 is staying at a free position, the cushions 33 are directed in the upward direction as drawn in real lines in FIG. 2, and the hammers 215 are brought into collision with the strings 204 without any interference with the cushions 33. In other words, the hammer stopper 30 permits the player to produce the acoustic piano tones through the collision between the hammers 215 and the strings 204.

When a player wishes to practice the fingering on the acoustic piano 1 without any acoustic piano tones, the player instructs the controller 70 to direct the hammer stopper 30 to the hammer shanks 214. Then, the controller 70 energizes the electric motor 34 by means of a current driver 235 (see FIG. 1), and the shaft 31 is rotated in the counter clockwise direction. The current driver 235 is another system component of the mute system 3.

When the cushions 33 are opposed to the hammer shanks 214 as drawn in dots-and-dash lines in FIG. 2, the current driver 235 stops the current, and the electric motor 34 does not rotate the shaft 31. The cushions 33 are moved on the trajectories of the hammers 215. Thus, the hammer stopper 30 enters the blocking position, and the cushions 33 and other cushion 34 are opposed to the hammer shanks 214 and damper wires 206, respectively, at the blocking position.

The player depresses the black/white key 201*a*/201*b*, and the depressed key 201*a*/201*b* actuates the action unit 210. The damper head 205*a* is spaced from the string 204, and the damper wire 206 is brought into contact with the cushion 35. The jack 213 escapes from the hammer butt 215*b*, and the hammer 215 starts the rotation toward the string 204. The hammer 215 starts to travel along the trajectory, and the hammer shank 214 is brought into collision with the cushion 33 before the collision between the hammer head 215*a* and the string 204. Thus, the hammer stopper 30 makes the hammers 215 rebound thereon before the collision between the hammer head 205*a* and the string 204. The string 204 does not vibrate, and any acoustic piano tone is not produced. After the rebound on the hammer stopper 30, the hammers 215 behave as similar to those in acoustic playing mode. Since the jacks 213 escape from the hammer butt 215*b* in the mute mode, the player feels the keytouch usual.

Description is hereinafter made on the pedal system 5 with concurrently reference to FIGS. 1 and 2. The pedal system 5 includes a damper pedal 240*a*, a damper pedal mechanism 241*a*, a soft pedal 240*b*, a soft pedal mechanism (not shown), a sostenuto pedal 240*c* and a sostenuto pedal mechanism (not shown).

The soft pedal mechanism (not shown) is connected to the hammer rail 202*e*, and a player decreases the distance between the hammer heads 215*a* and strings 204 by pushing down the soft pedal 240*b*. As a result, the hammer heads 215*a* are softly brought into collision with the strings 204, and the loudness of tones is reduced. The player selectively prolongs the tone by pushing down the sostenuto pedal. A sostenuto rod (not shown) is incorporated in the sostenuto pedal mechanism, and keeps the damper head 215*a* spaced from the string 204 in so far as the player pushes down the sostenuto pedal before releasing the depressed key 201*a*/201*b*.

A damper rod 241*b* is a component part of the damper pedal mechanism 241*a*, and a player bi-directionally rotates the damper rod 241*b* with the damper pedal 240*a*. When the player pushes down the damper pedal 240*a*, the damper rod 241*b* is rotated in the counter clockwise direction, and the damper rod 241*b* pushes all of the damper levers 205*b*. The damper levers 205*b* are rotated in the counter clockwise direction, and the damper heads 205*a* are spaced from the strings 204. Thus, the damper pedal 240*a* and damper pedal mechanism 241*a* make the damper heads 205*a* concurrently spaced from the strings 204 regardless of the black and white keys 201*a* and 201*b*. The damper pedal mechanism 241*a* keeps the damper heads 205*a* spaced from the strings 204 in so far as the player pushes down the damper pedal 240*a*. When the player releases the damper pedal 240*a*, the damper rod 241*b* leaves from the damper lever 205*b*, and the dampers 205 are spaced from and brought into contact with the strings 204 in response to the movements of black and white keys 201*a* and 201*b*.

The controller 70 is shared between the electronic tone generating system 2 and the mute system 3, and the electronic tone generating system 2 further includes an array of key sensors 230, pedal sensors 242, amplifiers 250, a volume controller 250*a*, loudspeakers 252 in a speaker box 252, a plug-fit socket 255 and a headphone 256. The key sensors 230, pedal sensors 242 and volume controller 250*a* are connected to the controller 70, and key position signals KS, pedal position signals PS and a volume control signal VS are respectively supplied from the key sensors 230, pedal sensors 242 and volume controller 250*a* to the controller 70. The controller 70 is connected to the amplifiers 250, which in turn is connected to the plug-in socket 255 and loud speakers 251, and an audio signal AD is supplied to the plug-in socket 255 and loudspeakers 251.

The controller 70 analyzes pieces of key position data on the key position signals KS and pieces of pedal position data on the pedal position signals PS for the movements of black and white keys 201*a*/201*b* and movements of pedals 240*a*/240*b*/240*c*, and produces music data codes representative of pieces of music data expressing a performance on the upright piano 1. The controller 70 produces the audio signal AD representative of the electronic tones to be produced on the basis of the music data codes, and supplies the audio signal AD through the amplifiers 250 to the loud speakers 252 and the plug-in socket 255. In this instance, the music data codes are produced in accordance with the MIDI (Musical Instrument Digital Interface) protocols.

When a user wishes to hear the electronic tones through the headphone 256, he or she inserts the plug of the headphone 256 into the plug-in socket 255. Then, the audio signal AD is supplied to the headphone, only, and any electronic tone is not produced through the loud speakers 252. On the other hand, in case where the headphone 256 is not connected to the plug-in socket 255, the audio signal AD is supplied to the loud speakers 251, and the audio signal AD is converted to the electronic tones through the loud speakers 251. The user changes the loudness of electronic tones by means of the volume controller 250*a*.

Photo-interrupters are used as the key sensors 230, and the detectable range of key sensors 230 are wider than the full stroke of the black and white keys 201*a*/201*b*. Thus, the current key position between the rest positions and the end positions is converted to the key position signals KS.

Photo-reflectors are used as the pedal sensors 242, and the detectable range of pedal sensors 242 is wider than the full stroke of the pedals 240*a*/240*b*/240*c*. For this reason, the current pedal position on the pedal trajectories is reported to the controller 70.

The hammer stopper 30, current driver 235 and controller 70 form the parts of the mute system 3 as described hereinbefore. A mode switch 220 serves as a man-machine interface, and also forms a part of the mute system.

When a user wishes to perform a piece of music through the acoustic piano tones, he or she selects the acoustic playing mode on the mode switch 220. A mode signal MS is supplied from the mode switch MS to the controller 70, and the controller requests the current driver 235 to change the hammer stopper 30 to the blocking position through the rotation of the electric motor 34. On the other hand, if the user wishes to practice the fingering on the keyboard 201 without disturbance of neighborhood, he or she requests the current driver 235 to change the hammer stopper 30 to the free position through the rotation of the electric motor 34. Thus, the user changes the mute piano between the acoustic playing mode and the mute mode through the mode switch 220.

Turning to FIG. 3 of the drawings, the system configuration of controller 70 is illustrated. The controller 70 includes an information processor 10, internal clocks 11, a tone generator 13, a signal interface 17, a shared bus system 18, a read only memory 21, which is abbreviated as "ROM", a random access memory 22, which is abbreviated as "RAM" and a flash memory 23. The information processor 10, internal clocks 11, read only memory 21, random access memory 22, flash memory 23, tone generator 13 and signal interface 17 are connected to the shared bus system 18 so that the information processor 10 accesses, supplies and transfers various sorts of information to the other system components 11, 21, 22, 23, 13 and 17 through the shared bus system 18.

The information processor 10 is an origin of the information processing capability of the controller 70, and accomplishes given tasks through execution of instruction codes.

The instruction codes are stored in the read only memory 21 together with other control parameters and data tables in the non-volatile manner, and form a computer program. The computer program expresses the tasks, and runs on the information processor 10. The computer program is hereinlater described in detail. One of the data tables is called as a damper pedal table, and the damper pedal table will be hereinlater described in detail.

Three music data codes are stored in the read only memory 21. One of the three music data codes is indicative of continuous buzzes, another of the three music data codes is indicative of buzzes at relatively long intervals, and yet another of the three music data codes is indicative of buzzes at relatively short intervals.

The random access memory 22 offers a temporary data storage to the information processor 10, and serves as flags. For example, the pieces of key position data, pieces of pedal position data and pieces of music data are, by way of example, stored in the temporary data storage in the random access memory 22.

The internal clocks 11 independently measure the lapse of time. One of the internal clocks is assigned to the time period between a note-on/note-off event and the previous note-on/previous note-off event.

The flash memory 23 is electrically programmable and erasable, and pieces of data are held in the flash memory 23 in the non-volatile manner. Default values are stored in the flash memory 23. One of the default values relates to the damper pedal table, and is expressed as "AD0".

The tone generator 13 includes a waveform memory, plural read-out circuits, a key assigner and effectors. The key assigner assigns the note-on events, which the music data codes express, to the read-out circuits, and the read-out circuits make pieces of waveform data read out from the waveform memory. A digital audio signal is produced from the pieces of waveform data. Certain music data codes stand for the effects of the pedals 240*a*/240*b*/240*c*, and the digital audio signal is modified through the effectors in the presence of the certain data codes. The music data codes are produced through the fingering on the keyboard 201, or are supplied from the outside of the mute piano.

The tone generator 13 varies the electronic tones depending upon the current pedal position of the damper pedal 240*a*. While the damper pedal 240*a* is staying the rest region, any effect is not given to the electronic tones. The effectors give a half-pedal effect to the electronic tones in the half pedal region, and give a damper effect to the electronic tones in the damper-free position.

The signal interface 17 includes analog-to-digital converters, digital-to-analog converters, data buffers, amplifiers and driver circuits. The mode switch 220, key sensors 230, a control board 26, the pedal sensors 242, current driver 235, a MIDI interface 14 and the amplifiers 250 are connected to the signal interface. Analog signals such as the mode signal MS, key position signals KS and pedal position signals PS are converted to a digital mode signal MSd, digital key position signals KSd and digital pedal position signals PSd, and the digital signals MSd, KSd and PSd are temporarily stored in the data buffers. The information processor 10 periodically accesses the data buffers, and fetches the digital mode signal MSd, digital key position signals KSd and digital pedal position signals PSd from the data buffers. On the other hand, digital signals such as digital audio signal and digital motor control signal are converted to the analog audio signal AD and analog control signals through the digital-to-analog converters, and the analog signals are supplied to other system components through the amplifiers. The music data codes are transferred between the data buffers and the MIDI interface 14 through the driver circuits, and the information processor 10 periodically fetches the music data codes from the data buffers. Another external instrument 15 is connectable to the MIDI interface 14 so that the music data codes are transferred between the controller 70 and external instrument 15 through the MIDI interface 14.

Various switches are provided on the control board 26. One of the switches is a power switch, and a user activates the controller 70 by turning on the power switch. Another switch is assigned to the instruction to finish a calibration work, which will be hereinafter described in detail.

Description is hereinafter made on a calibration of the electronic tone generating system 2 together with the damper pedal table. The damper pedal table is stored in the read only memory 21, and FIG. 4 shows contents PL1 of the damper pedal table.

A message [Bn 40 dd] stands for the effect of the damper pedal in the MIDI protocols. [B] [n]. [4], [0] and [d] are hexadecimal numbers. [Bn] and [40] are a status byte expressing the control change and a data byte expressing the control number and are defined in the MIDI protocols. The third byte [dd] is a data byte expressing a value from [00] to [7F]. The value [dd] is hereinafter referred to as a "MIDI value". The pedal sensor 242, which monitors the damper pedal 240*a*, supplies the analog pedal signal PS to the signal interface 17, and is converted to the digital pedal signal PSd. "AD1" stands for the value of the digital pedal signal PSd. The difference between the value AD1 of digital pedal signal PSd and the default value AD0 is referred to as an "input value of table". The input value of table is expressed as [0x bb], and [bb] is hexadecimal numbers. In this instance, the manufacturer writes the default value AD0 of [0x 40] in the flash memory 23 upon completion of assembling work.

The contents PL1 are prepared as follows. First, a mute piano is prepared, and is same model as the mute piano implementing the embodiment. The black and white keys are repeatedly depressed so that the acoustic piano tones are produced through the mechanical tone generator 4. The damper pedal 240*a* is pressed down, and the pedal stroke is varied. The digital pedal position signal PSd and music data code, which expresses the effect of damper pedal, are monitored, and the input values of table [0x bb], i.e., (AD1−AD0) are correlated with the value [dd] of the music data code. Preliminary plots, which express the relation between the input value of table [0x bb] and the music data codes, are obtained, and the acoustic piano tones in the half-pedal state are correlated with the value [dd] of the music data codes. Thereafter, the preliminary plots are modified in Such a manner that the half-pedal effect is given to the acoustic piano tones at [58] of the third byte of the music data code and input value [0x 00]. As a result, the contents PL1 of damper pedal table are determined as shown in FIG. 4.

In the damper pedal table, the input value [0x 00], which is equivalent to the decimal number of zero is correlated with the MIDI value [58], which is equivalent to the decimal number "88". In other words, then the input value of table [0x bb] is zero, the MIDI value [58] is read out from the damper pedal table, and is supplied to the tone generator 13.

FIGS. 5 and 6 show an essential part of the computer program, and a worker calibrates the electronic tone generating system 2 with the assistance of the computer program. Though not shown in FIGS. 5 and 6, the computer program periodically branches into a subroutine program for transferring pieces of data from the signal interface 17 to the random access memory 22.

A worker firstly removes the upper front board 24 from the piano cabinet 202. The worker may further remove the top board 25 from the piano cabinet 202. Then, the dampers 205 and strings 204 are exposed to the worker. As a result, the worker can visually confirm the movements of the dampers 205.

The worker energizes the controller 70. Then, the computer program starts to run on the information processor 10. First, the information processor 10 initializes other system components of the controller 70 as by step S101. The information processor 10 writes initial values into registers, which are prepared in the random access memory 22, and transfers default values, parameters and tables to the random access memory 22. Thus, the damper pedal table, three music data codes and default value AD0 are read out from the read only memory 21 and flash memory 23, and are written into the random access memory 22 in the initialization at step S101.

Subsequently, the information processor 10 carries out a preliminary work on the system components of the electronic tone generating system 2 and system components of the mute system 3. For example, the information processor checks the control board 26, key sensors 230 and pedal sensors 242 to see whether or not any malfunction is found in those system components in the preliminary work at step S102.

Subsequently, the information processor 10 checks the mode switch 220 to see whether or not a user instructs to calibrate the damper pedal table as by step S103. If the worker wishes to play a piece of music on the mute piano, he or she instructs to enter the acoustic playing mode, mute mode or electronic playing mode, and the answer at step S103 is given negative "No". With the negative answer "No", the information processor 10 proceeds to step S112. The jobs at steps S112 to S119 will be hereinlater described.

Assuming now that the worker instructs the calibration work to the information processor 10 through the mode switch 220, the answer at step S103 is given affirmative "Yes" and the information processor 10 proceeds to step S104, and checks the power switch to see whether or not the worker wishes to finish the calibration work. Since the worker has just instructed the calibration work, the answer at step S104 is given negative "No".

With the negative answer "No", the information processor 10 starts periodically to fetch the value AD1 of damper pedal stroke represented by the digital pedal position signal PSd as by step S105. The values AD1 of damper pedal stroke are periodically transferred to the random access memory 22, and the previous value AD1 is replaced with the new value AD1.

The worker gradually presses down the damper pedal 240*a*. When the damper pedal 240*a* starts to leave from the strings 204, the user further presses down the damper pedal 240*a* by 1 millimeter, the damper pedal 240*a* surely enters the half pedal region between the rest region and the damper-free region. However, the pedal stroke until the half pedal region is not always 1 millimeter. The pedal stroke to be required is fallen within the range of 1±0.5 millimeter.

The information processor 10 subtracts the default value AD0 from the current value AD1, and determines the input value [0x bb] through the subtraction. The information processor 10 looks up the damper pedal table, and reads out the MIDI value [dd] corresponding to the input value [0x bb] from the damper pedal table as by step S106.

The MIDI values equal to less than [57] are corresponding to the continuous buzzes, the MIDI values between [58] and [7E] are corresponding to the buzzes at relatively long intervals, and the MIDI values equal to or greater than [7F] are corresponding to the buzzes at relatively short intervals. The information processor 10 compares the read-out MIDI value

[dd] with the above-described three sections, and determines that the buzzes are to be produced as notification sound. The information processor 10 transfers the music data code representative of the notification sound from the random access memory 22 to the electronic tone generator 13 so that the buzzes are radiated from the loudspeaker 251 as by step S1107.

After the transfer of the music data code indicative of the notification sound at step S107, the information processor 10 checks the random access memory 22 to see whether or not the worker depresses a preliminary admissible key as by step S108. In this instance, the black key 201*a* assigned the key number 86 serves as the preliminarily admissible key.

While the answer at step S108 is being given negative "No", the information processor 10 returns to step S104, and reiterates the loop consisting of steps S104 to S108.

While the information processor 10 is reiterating the loop consisting of steps S104 to S108, the worker changes the pedal stroke, and visually checks the dampers 205 to see whether or not the dampers 205 surely leave from the strings 204 at the change from the continuous buzzes to the buzzes at relatively long intervals.

While the worker is finding the dampers 205 to leave from the strings 204 before and after the change of notification sound, the worker depresses the preliminarily admissible key at the time when the dampers 205 start to leave from the strings 204, and repeatedly changes the relative position between the damper pedal mechanism 241*a* and the pedal sensor 242.

When the information processor 10 acknowledges that the preliminarily admissible key is depressed, the answer at step S108 is changed to affirmative "Yes", and the information processor 10 stores the value AD1 of damper pedal stroke into the random access memory 22 as by step S109.

While the worker is seeking the optimum relative position between the damper pedal mechanism 241*a* and the damper pedal sensor 242, the information processor 10 repeatedly rewrites the value AD1 in the random access memory 22 every time the worker depresses the preliminarily admissible key 201*a*.

The information processor 10 checks a decision key to see whether or not the worker decides that the boundary between the rest region and the half pedal region is correct as by step S110. While the worker wishes to continue the regulation work, the worker does not depress the decision key, and the answer at step S110 is given negative "No". Then, the information processor 10 returns to step S104, and reiterates the loop consisting of steps S104 to S110. In this instance, the white key 201*b* assigned the key number 88 serves as the decision key.

Thus, the black and white keys 201*a* and 201*b* are used as control switches. This feature makes it possible to reduce the number of switches on the control board 26.

When the worker confirms that the dampers 205 start to leave from the strings 204 at the change of the notification sound, the worker pushes the decision key 201*b*, and the answer at step S110 is changed to affirmative "Yes".

Then, the information processor 10 reads out the current value AD1 from the random access memory 22, and rewrites the default value in the random access memory 22 and flash memory 23 from AD0 to AD1 as by step S111. The current value AD1 serves as the default value AD0.

Upon completion of the jobs at step S111, the information processor 10 returns to step S102, and waits for the next instruction.

The calibration work is usually carried out before the delivery to users. However, it is possible to carry out the calibration work by a user or a tuning worker at user's home.

After the calibration work, the mute piano is assumed to be delivered to a user. The user energizes the controller 70. Then, the information processor 10 carries out the initialization at step S101 and preliminary work at step S102. The user is assumed to give the instruction for the mute mode to the controller 70.

The information processor 10 acknowledges the user's instruction, and the answer at step S103 is given negative "No". With the negative answer at step S103, the information processor 10 checks the given instruction to see whether or not the mute piano is to be established in the mute mode as by step S112.

If the user instructs the electronic playing mode or acoustic playing mode, the answer is given negative "No", and the information processor 10 proceeds to step S119 for jobs in the mode requested to the user.

In this instance, the user has given the instruction for the mute mode so that the answer at step S112 is given affirmative "Yes", and the information processor 10 checks the random access memory 22 to see whether or not the user presses down the damper pedal 240*a* as by step S113. While the answer is given negative "No", the information processor 10 proceeds to step S116, and checks the random access memory 22 to see whether or not the user depresses or releases any one of the black and white keys 201*a*/201*b* as by step S116.

If all of the black and white keys 201*a*/201*b* do not change the key positions, the answer at step S116 is given negative "No", and the information processor 10 returns to step When the user depresses or releases a black key 201*a* or a white key 201*b* without pressing down the damper pedal 240*a*, the information processor 10 proceeds to step S117, and transfers the music data code or codes representative of the note-on event or note-off event for the depressed/released key 201*a*/201*b* to the electronic tone generator 13.

Subsequently, the information processor 10 causes the electronic tone generator 13 to produce the digital audio signal without any damper effect. The digital audio signal is converted to the analog audio signal AD, and the electronic tone or tones are produced through the headphone 256.

If, on the other hand, the user presses down the damper pedal 240*a*, the answer at step S13 is changed to affirmative "Yes". With the positive answer at step S113, the information processor 10 reads out the current value AD1 and default value AD0 from the random access memory 22, and subtracts the default value AD0 from the current value so as to determine the input value [0x bb]. The information processor 10 accesses the damper pedal table with the input value [0x bb], and reads out the MIDI value [dd] from the damper pedal table as by step S114.

If both of the current value AD1 and default value AD0 are [0x 40], the input value is [0x 00] so that the MIDI value of [58] is read out from the damper pedal table. If the current value AD1 and default value AD0 are [0x 4A] and [0x 40], respectively, the input value is [0x 0A] so that the MIDI value is [60], which is greater than [58]. If the current value AD1 and default value AD0 are [0x 40] and [0x 45], respectively, the input value is [53] which is less than [58].

The information processor 10 compares the MIDI value [dd] with the boundary between the rest region and half pedal region and boundary between the half pedal region and the damper-free region, and determines that the effect to be given to the electronic tones. The information processor 10 produces the music data code representative of the effect to be given to the electronic tone or tones, and transfers the music data code to the electronic tone generator 13 as by step S115.

Upon completion of the jobs at step S115, the information processor 10 proceeds to step S116. When the user depresses a black key 201*a* or a white key 201*b*, the information processor 10 transfers the music data code representative of the note-on event to the electronic tone generator 13 at step S117. Since the music data code representative of the damper effect or half-pedal effect has been already transferred to the electronic tone generator 13, the damper effect or hall-pedal effect is given to the electronic tone at step S118.

Thus, the information processor 10 reiterates the loop consisting of steps S112 to S118 until the mute piano exits the mute mode.

As will be understood from the foregoing description, the relation between the input value [0x bb] and the MIDI value [dd] is directly calibrated with the assistance of the computer program installed in the controller 70. In the calibration work, a worker visually confirms the damper actions, and makes the input value [0x bb] at the entry into the half-pedal region consistent with the damper actions. In other words, the electronic entry into the half pedal region on the relation is surely made consistent with the mechanical entry into the half pedal region. Thus, the relation, which the damper pedal table expresses, is correctable on the basis of the damper actions, and is made reliable through the calibration.

Moreover, the relation between the input value [0x bb] and the MIDI value is directly calibrated so that neither normalization table nor inverted normalization table is required for the mute piano.

In the preferred embodiment, the black key and white key serve as the preliminary admissible key and decision key so that any new switch is not required for the calibration work.

Although particular embodiments of the present invention have been shown and described, it will be apparent to those skilled in the art that various changes and modifications may be made without departing from the spirit and scope of the present invention.

The electric motor 34 may be replaced with a supersonic motor.

Multi-contact switches may be used as the key sensors. A velocity sensor or an acceleration sensor is available for the keyboard 201, because it is possible to convert the velocity and acceleration to the current position.

The black key assigned the key number 86 and white key assigned the key number 88 do not set any limit to the technical scope of the present invention. Other keys in the keyboard 201 are available for the preliminarily admission and decision. More than one key 201*a*/201*b* may be concurrently depressed to give user's instructions. Otherwise, switches on the control board 26 may serve as the preliminarily admission key and decision key.

The notification sound does not set any limit into the technical scope of the present invention. Three light sources may be prepared for the three regions, i.e., the rest region, half pedal region and damper-free region so that the controller 70 energizes one of the three light sources depending upon the input value [0x bb].

The damper pedal table does not set any limit to the technical scope of the present invention. The relation between the input value [0x bb] and the MIDI value [dd] may be expressed as an equation so as to make the information processor determine the MIDI value on the basis of the input value [0x bb].

The preliminary admissible key may be depressed at the boundary between the half pedal region and the damper-free region. Otherwise, when the dampers 205 start to leave the strings 204, the user may admit the entry into the half pedal region. In this instance, the user depresses the preliminary admissible key immediately after the movements of dampers 204.

The input value [0x bb] may be corresponding to the MIDI value [dd] at more than one point. The point at which the input value [0x bb] is correlated with the MIDI value [dd] may be calculated on the basis of the boundary between the rest region and the half pedal region and the boundary between the half pedal region and the damper-free region. When the dampers 205 slightly move on the strings 204, the damper pedal 240*a* reaches the boundary between the rest region and the half pedal region. When the dampers 205 are spaced from the strings 204, the damper pedal 240*a* reaches the boundary between the half pedal region and the damper-free region. The point at which the input value [0x bb] is correlated with the MIDI value [dd] may be given as an interior division point.

The preliminary admissible key and decision key do not set any limit to the technical scope of the present invention. The dampers 205 may be monitored with sensors. In this instance, the controller 205 judges the half-pedal region on the basis of the detecting signal supplied from the sensors.

In the preferred embodiment, the damper pedal 240*a* is pressed down by a user in the calibration work. The user may reduce the force on the damper pedal 240*a* so as to permit the damper pedal 240*a* gradually returns toward the rest position. Otherwise, the user may reciprocally moves the damper pedal 240*a* so as to permit the controller 70 to correlate the input value [0x bb] with the MIDI value [dd] as the mean value between the forward movement the and backward movement.

The detectable range of a pedal sensor may be narrower than the detectable range of the pedal sensor 240*a*. The pedal sensor may simply turn on and off at a pedal position in the half pedal region.

The flash memory 23 does not set any limit to the technical scope of the present invention. Any sort of rewritable memory is available for the default value. The default value may be stored in a hard disk.

A solenoid-operated pedal actuator may be temporarily installed for the damper pedal 240*a*. The controller 70 presses down and releases the damper pedal 240*a* by means of the solenoid-operated pedal actuator.

More than two different effects may be given to the tone or tones depending upon the pedal stroke. For example, the half pedal region may be divided into plural sub-regions, and the half-pedal effect is varied depending upon the sub-region where the damper pedal 240*a* presently travels.

The damper pedal 240*a* does not set any limit to the technical scope of the present invention. The calibration work may be carried out for any pedal such as, for example, the soft pedal 240*b* in so far as the player presses down the pedal for more than one effect to be given to the tones.

The acoustic piano 1 does not set any limit to the technical scope of the present invention. The present invention may appertain to a percussion musical instrument such as, for example, a celesta. The present invention may appertain to an electric piano.

The present invention may appertain to another sort of hybrid keyboard musical instruments such as an automatic player piano and a recording system for an acoustic piano.

The calibration mode does not set any limit to the technical scope of the present invention. A calibration system may be physically independent of the mute piano. In this instance, the revised version of damper pedal table is loaded from the calibration system to the flash memory 23 of the controller 70.

The MIDI protocols do not set any limit to the technical scope of the present invention. Any music protocols are employable in so far as the pitch of tones to be produced and pedal effects are defined in the music protocols.

The component parts of mute piano are correlated with claim languages as follows. The black keys 201*a* and white keys 201*b* are corresponding to "plural keys", and the damper pedal 240*a* serves as "at least one pedal". The rest region, half pedal region and damper-free region are corresponding to "more than two regions". The mechanical tone generator 4 or the action units 210, hammers 215, dampers 205 and strings 204 form in combination a "tone generator".

The key position signals KS and pedal position signal PS are corresponding to "key signals" and a "pedal signal", respectively. The dampers 205 serve as "component parts". The flash memory 23, random access memory 22 and read only memory 21 as a whole constitute a "memory". The MIDI protocols serve as "music protocols". The input value [0x bb] expresses the current pedal position on the damper pedal trajectory so that the pedal position is equivalent to a "current physical quantity". The MIDI protocols are equivalent to "music protocols".

The strings 204 serve as "other component parts" of the tone generator. The amplifiers 250, loud speakers 251 and headphone 256 as a whole constitute a "sound system".

What is claimed is:

1. A musical instrument for producing pieces of music data expressing tones, comprising:

a keyboard having plural keys selectively depressed so as to specify pitch of said tones in a performance of a piece of music;

at least one pedal pressed down so as to specify a pedal effect to be given to at least one of said tones in said performance, and moved along a pedal trajectory divided into more than two regions, one of said more than two regions being assigned to the tones without any pedal effect, others of said more than two regions being respectively assigned to the tones with pedal effects different from one another;

a mechanical tone generator connected to said plural keys and said at least one pedal, having vibratory component parts capable of mechanically producing said tones at the specified pitch through vibrations thereof in said performance, and giving the pedal effect to said at least one of said tones in said performance;

plural key sensors monitoring said plural keys, and producing key signals representative of key movements in said performance;

at least one pedal sensor monitoring said at least one pedal, and producing a pedal signal representative of a pedal movement on said pedal trajectory in said performance and a calibration carried out before said performance;

a sound system for producing electronic tones from an audio signal; and a controller connected to said plural key sensors, said at least one pedal sensor, said mechanical tone generator and said sound system, producing music data codes defined in music protocols and expressing at least said specified pitch of said tones and the pedal effect to be given to said at least one of said tones on the basis of said key signals, said pedal signal and relation during said performance on said musical instrument, said relation being established between an input value expressing a current physical quantity of said at least one pedal and a value of the music data code expressing said pedal effect, and having a memory storing said relation in a rewritable manner so as to make it possible to optimize said relation with respect to actual movements of component parts of said mechanical tone generator related to said pedal effects in said calibration, said controller including an electronic tone generator connected to said sound system, capable of producing said audio signal representative of said electronic tones to be produced at said specified pitch in said performance on the basis of said music data codes expressing said at least specified pitch, and modifying said audio signal in said performance so as to give said pedal effect on the basis of said music data code expressing said pedal effect and prepared with reference to said relation, said tones produced by said mechanical tone generator and said electronic tones produced through said electronic tone generator being selective.

2. The musical instrument as set forth in claim 1, in which said controller reads said value of said music data code from said relation depending upon said input value so as to produce said music data code expressing said pedal effect to be given to said at least one of said tones and said electronic tones in said performance.

3. The musical instrument as set forth in claim 2, in which said input value is expressed as (AD1−AD0) where AD1 is a value of said physical quantity represented by said pedal signal and AD0 is a default value, and said default value is changed through the optimization in said calibration.

4. The musical instrument as set forth in claim 3, in which said default value is indicative of a certain point in one of said more than two regions assigned to one of said pedal effects.

5. The musical instrument as set forth in claim 1, in which said vibratory component parts are vibratory at different values of frequency, and said component parts have different influences on said vibrations of said vibratory component parts so as to give said pedal effects to said tones in said performance.

6. The musical instrument as set forth in claim 5, in which said component parts take up said vibrations of said vibratory component parts on the condition that said component parts are perfectly held in contact with said vibratory component parts, permits said vibratory component parts freely to vibrate on the condition that said component parts are perfectly spaced from said vibratory component parts, and reduces the amplitude of said vibrations on the condition that said component parts are softly in contact with said vibratory component parts.

7. The musical instrument as set forth in claim 6, in which said relation is optimized in said calibration in such a manner that said conditions are satisfied by said at least one pedal in said more than two regions, respectively.

8. The musical instrument as set forth in claim 1, further comprising a sound system for producing electronic tones from an audio signal, wherein said controller includes an electronic tone generator connected to said sound system, produces said audio signal representative of said electronic tones to be produced at said specified pitch in said performance on the basis of said music data codes expressing said at least said specified pitch, and modifies said audio signal in said performance so as to give said pedal effect on the basis of said music data code expressing said pedal effect.

9. The musical instrument as set forth in claim 1, further comprising a mute system interrupting propagation of movements of said plural keys to said vibratory component parts of said tone generator in said performance so as to prohibit said mechanical tone generator from generation of said tones, whereby a player plays said piece of music with the assistance of said electronic tone generator and said sound system in said performance.

10. The musical instrument as set forth in claim 1, in which a computer program runs on said controller for optimizing said relation in said calibration.

11. The musical instrument as set forth in claim 10, in which said computer program makes said controller to give a human worker different notifications in said more than two regions so as to assist said human worker in the optimization in said calibration.

12. The musical instrument as set forth in claim 11, in which said notifications are respectively given to said human worker as different sorts of sound.

13. A controlling system for a musical instrument having plural keys respectively assigned pitch names of tones to be produced, at least one pedal moved along a pedal trajectory divided into more than two regions and a mechanical tone generator connected to said plural keys and said at least one pedal, capable of producing said tones at specified pitch names through vibrations of vibratory component parts thereof in a performance of a piece of music and giving pedal effects in said performance, one of said more than two regions being assigned to the tones without any pedal effect, others of said more than two regions being respectively assigned to the tones with said pedal effects different from one another, comprising:

plural key sensors monitoring said plural keys, and producing key signals representative of key movements in said performance;

at least one pedal sensor monitoring said at least one pedal, and producing a pedal signal representative of a pedal movement on said pedal trajectory in said performance and a calibration carried out before said performance;

a sound system for producing electronic tones from an audio signal; and a controller connected to said plural key sensors, said at least one pedal sensor, said mechanical tone generator and said sound system, producing music data codes defined in music protocols and expressing at least said specified pitch names of said tones and the pedal effect to be given to said at least one of said tones on the basis of said key signals, said pedal signal and relation during said performance on said musical instrument, said relation being established between an input value expressing a current physical quantity of said at least one pedal and a value of the music data code expressing said pedal effects, and having a memory storing said relation in a rewritable manner so as to make it possible to optimize said relation with respect to actual movements of component parts of said mechanical tone generator related to said pedal effects in said calibration, said controller including an electronic tone generator connected to said sound system, capable of producing said audio signal produced at said specified pitch names on the basis of said music data codes expressing said at least said specified pitch names in said performance and modifying said audio signal in said performance so as to give said pedal effect on the basis of said music data code expressing said pedal effect and prepared with reference to said relation, said tones produced by said mechanical tone generator and said electronic tones produced through said electronic tone generator being selective.

14. The controlling system as set forth in claim 13, in which said controller reads said value of said music data code from said relation depending upon said input value in said performance so as to produce said music data code expressing said pedal effect to be given to said at least one of said tones and said electronic tones.

15. The controlling system as set forth in claim 14, in which said input value is expressed as (AD1−AD0) where AD1 is a value of said physical quantity represented by said pedal signal and AD0 is a default value, and said default value is changed through the optimization in said calibration.

16. The controlling system as set forth in claim 15, in which said default value is indicative of a certain point in one of said more than two regions assigned to one of said pedal effects.

17. The controlling system as set forth in claim 13, further comprising a sound system for producing electronic tones from an audio signal, and an electronic tone generator connected between said controller and said sound system, producing said audio signal produced at said specified pitch on the basis of said music data codes expressing said at least said specified pitch in said performance and modifying said audio signal so as to give said pedal effect on the basis of said music data code expressing said pedal effect in said performance.

18. The controlling system as set forth in claim 13, further comprising a mute system interrupting propagation of movements of said plural keys to said vibratory component parts of said tone generator in said performance so as to prohibit said mechanical tone generator from generation of said tones, whereby a player plays said piece of music with the assistance of said electronic tone generator and said sound system.

19. The controlling system as set forth in claim 13, in which a computer program runs on said controller for optimizing said relation in said calibration.

20. The controlling system as set forth in claim 19, in which said computer program makes said controller to give a human worker different notifications in said more than two regions in said calibration so as to assist said human worker in the optimization.

21. The controlling system as set forth in claim 20, in which said notifications are respectively given to said human worker as different sorts of sound.

* * * * *